US005954473A

United States Patent [19]

Folsom

[11] Patent Number: 5,954,473

[45] Date of Patent: Sep. 21, 1999

[54] READILY ADJUSTABLE CUT SHEET STACKER

[75] Inventor: James C. Folsom, Sanford, Me.

[73] Assignee: Moore U.S.A., Inc., Grand Island, N.Y.

[21] Appl. No.: 08/880,391

[22] Filed: Jun. 23, 1997

[51] Int. Cl.[6] ..... B65H 31/20; B65H 43/04; B65H 31/34; B65G 57/00

[52] U.S. Cl. ..... 414/788.9; 414/789; 414/790.3; 414/900; 271/223; 271/198; 271/213; 271/214

[58] Field of Search ..... 271/171, 223, 271/240, 198, 200, 213, 214, 215, 220; 414/788.9, 789, 790.3, 900

[56] References Cited

U.S. PATENT DOCUMENTS

| | | | |
|---|---|---|---|
| 3,580,145 | 5/1971 | Vermes | 414/789 |
| 3,690,649 | 9/1972 | Brookhyser . | |
| 3,698,707 | 10/1972 | Lucas . | |
| 4,346,882 | 8/1982 | Pessina et al. | 271/223 |
| 4,426,073 | 1/1984 | Mizuma . | |
| 4,581,005 | 4/1986 | Moen | 271/233 |
| 4,607,834 | 8/1986 | Dastin | 271/223 |
| 4,661,091 | 4/1987 | Moen | 271/233 |
| 4,678,177 | 7/1987 | Landa . | |
| 4,725,180 | 2/1988 | Kasamatsu et al. | 414/790.3 |
| 4,799,847 | 1/1989 | Bodewein . | |
| 4,826,421 | 5/1989 | Asano et al. | 271/223 |
| 4,982,945 | 1/1991 | Marasco et al. | 271/223 |
| 5,031,893 | 7/1991 | Yoneda et al. | 271/200 |
| 5,039,083 | 8/1991 | Senn . | |
| 5,147,092 | 9/1992 | Driscoll et al. . | |
| 5,265,731 | 11/1993 | Van de Ven . | |
| 5,297,787 | 3/1994 | Shirai | 271/223 |
| 5,366,212 | 11/1994 | Crowley et al. . | |
| 5,366,217 | 11/1994 | Tokuno et al. . | |
| 5,409,207 | 4/1995 | Freeman . | |
| 5,411,252 | 5/1995 | Lowell | 271/223 |
| 5,423,656 | 6/1995 | Filsinger et al. | 271/223 |
| 5,429,475 | 7/1995 | Mohr | 271/213 |
| 5,492,318 | 2/1996 | Wright . | |
| 5,516,093 | 5/1996 | Ballard et al. | 271/240 |
| 5,545,000 | 8/1996 | Gorsky | 414/790.3 |
| 5,590,873 | 1/1997 | Smart et al. | 271/223 |
| 5,639,078 | 6/1997 | Mandel et al. | 271/223 |
| 5,692,745 | 12/1997 | Neifert et al. | 271/223 |

*Primary Examiner*—H. Grant Skaggs
*Assistant Examiner*—Wonki K. Park
*Attorney, Agent, or Firm*—Nixon & Vanderhye, P.C.

[57] ABSTRACT

A variable cut sheet stacker has an internal stacking volume that is readily adjusted (in length, width and height) for a large variety of form sizes and thicknesses. First and second side members are spaced from each other horizontally and the positions between them can be adjusted, typically uniformly moved with respect to a central support. An inlet and support is provided in an inlet for the stacker, having a ramp, and an outlet end guide is adjustable with respect to the inlet end support. A top conveyor conveys cut sheets past the inlet support toward the outlet end guide in a first direction, and a bottom support is vertically spaced in an adjustable manner from the top conveyor for supporting cut sheets. The open interior volume defined by these elements is substantially a rectangular prism. The top conveyor includes a frame that is pivotable about a horizontal axis perpendicular to the first direction to move between a conveyance position and an adjustment-facilitating position. An eject device, in the form of a substantially-vertical paddle, mounted with each side member, is provided for movement with respect to the side members in the first direction to eject a stack of forms and then automatically stop.

20 Claims, 6 Drawing Sheets

READILY ADJUSTABLE CUT SHEET STACKER

BACKGROUND AND SUMMARY OF THE INVENTION

In the processing of sheets, such as business forms (which can be single paper thickness or multiple ply), there are many circumstances in which it is desirable to create a vertical stack of the forms, or other sheets, between processing steps. Some facilities wish to provide stacks of a wide variety of different types of sheets, which can be very difficult to accomplish utilizing conventional equipment. For example, some facilities wish to be able to sort or group, and stack, booklets, mailers, pressure seal forms and a wide variety of other types of business forms which ultimately are either shrink wrapped, banded together, stapled, bound, or the like. These different types of business forms have a wide variety of different widths and lengths, however, and also the optimum size of a stack varies greatly from one type of business form to another. Therefore, any equipment that is to accommodate this need must be readily adjustable and in a number of different manners. Also, it is important when forming stacks to make sure that the edges of the forms or other sheets are almost perfectly aligned with each other in order to facilitate further processing or handling.

According to the present invention, a relatively-simple and straight-forward variable cut sheet stacker is provided which is able to handle a wide variety of different sizes of business forms or other sheets, in a simple and effective manner, and may be easily adjusted to properly handle all sizes and types of common forms. The stacker according to the invention is also readily utilized with a wide variety of scanners or other equipment to effect separation between forms or other sheets for grouping and stacking, and is readily utilizable with conventional aligning mechanisms. A stacker according to the invention is also versatile, allowing center, right, or left alignment possibilities.

According to one aspect of the present invention a variable cut sheet stacker is provided comprising the following components: First and second side members which extend substantially vertically and are spaced from each other substantially horizontally. An inlet end support at an inlet for the stacker. An outlet end guide disposed opposite the inlet support horizontally spaced therefrom at an outlet for the stacker. A top conveyor for conveying cut sheets past the inlet support toward the outlet end guide, in a first direction. A bottom support vertically spaced from the top conveyor for supporting cut sheets. The inlet end support and outlet end guide, top conveyor, side members, and bottom support defining an open interior volume having substantially a rectangular prism configuration. Means for adjusting the relative positions of the side members with respect to each other. Means for adjusting the horizontal spacing of the inlet end support and the outlet end guide in the first direction. And, means for adjusting the vertical spacing of the top conveyor and bottom support.

The top conveyor typically comprises a frame that is pivotable about a horizontal axis substantially perpendicular to the first direction (preferably, at the outlet end of the stacker) to move between a conveyance position and an adjustment-facilitating position. The outlet end guide is preferably mounted on the top conveyor for pivotable movement therewith. The inlet end support preferably is fixed and includes an upper ramp which cooperates with the conveyor. The means for adjusting the horizontal spacing of the inlet end support and the outlet end guide may comprise any conventional device that allows linear adjustment of one guide component with respect to another. This may include pneumatic cylinders, cam operators, rotating screws with traveling nuts, or the like. In the preferred, simple structure according to the invention, the adjustment means comprises means for mounting the outlet end guide to the conveyor so that the outlet end guide is movable with respect to the inlet end support to adjust the position therebetween, such as a pair of guide rods mounted to the conveyor supporting frame. The guide rods are elongated in the first direction, and the outlet end guide comprises a vertical plate having openings for receiving the rods. Conventional bushings are provided in the opening so that when the vertical plate is moved to a position desired along the guide rods, it will stay in that position until moved again. If desired or necessary, detents or latching mechanisms may be provided for holding it in place.

The top conveyor typically includes first and second rollers rotatably mounted to the frame and extending substantially perpendicular to the first direction. At least one of the rollers—preferably the roller adjacent the outlet, where the pivoting action of the conveyor can take place—is driven by a conventional drive structure such as an electric motor connected to a shaft. A plurality of conveyor tapes or belts extend between the rollers, preferably having a substantially circular cross section, and being of elastic material. The inlet end support may comprise a guide cooperating with a plurality of conveyor tapes for positively guiding the tapes when moving in the first direction.

An eject means is preferably also associated and adjustable with the side members for, upon activation, moving sheets stacked in the interior volume out of the outlet end. The eject means may comprise conventional linear pushing elements, such as driven by pneumatic cylinders, rotatable screws with traveling nuts, or the like; however, preferably the eject means may comprise a pair of substantially-vertical paddles, either one or two mounted with each side member for movement with respect to each of the side members in the first direction. The paddles are mounted on a conveyance element, such as a tape or chain, the paddles extending outwardly from a conveyor belt. If two paddles are provided for each side member, then each paddle of a pair is spaced from the other about 180° along the path of movement. The paddles may be moved in the first direction by any conventional drive mechanism, such as a conventional electric motor driving a shaft, and another drive shaft geared to the driven shaft to rotate the tape or chain to which the paddles are connected, a conventional clutch, etc. The paddle moving means typically also includes means for automatically stopping movement, for example after engaging an end-of-cycle tab and switch, the switch disengaging a clutch, or drive train, while the motor continuously runs, and the tab positively stopping movement of the paddle.

The inlet end support preferably comprises a central support substantially evenly spaced between the side members. The means for adjusting the positions of the side members with respect to each other move the side members uniformly toward and away from the central support. These adjusting means can be any suitable conventional structure and may be geared, ganged, or otherwise connected together for uniform movement. In the preferred embodiment, the means for adjusting the positions in the side members comprises a screw threaded shaft extending between the side members substantially perpendicular to the first direction, and a traveling nut portion of each of the side members for engaging the screw threaded shaft and linearly moving toward and away from the central support in response to rotation of the screw threaded shaft. The screw threaded shaft is rotated by a conventional hand crank, or by an electric motor.

The means for adjusting the vertical spacing of the top conveyor and bottom support also may comprise any suitable conventional structure. For example, a number of different support trays may be provided that can be inserted into the interior volume and have various heights and interior length and width dimensions, and may be fastened in place by magnets, pins and/or the like. Alternatively, the vertical spacing can be provided by mounting the bottom support on one or more pneumatic cylinders that are moved up and down depending upon the height of the interior volume desired. By utilizing pneumatic cylinders, or like linear actuators, for moving the bottom support up and down, it is not necessary to adjust the position of an outfeed conveyor, but rather the bottom support may be moved to vertical alignment with an outfeed conveyor and then the paddles are actuated to eject the forms from the interior volume onto the outfeed conveyor.

Preferably, the means for adjusting the relative positions of the side members with respect to each other, the means for adjusting the horizontal spacing of the inlet end support and the outlet end guide in the first direction, and the means for adjusting the vertical spacing of the top conveyor and bottom support, collectively provide for adjustment of the internal volume from between approximately 3.5 inches by 3.5 inches by 1 sheet thick in height, and approximately 12 inches by 12 inches by 3 inches (height).

The stacker according to the invention also is preferably associated with, and in combination with, a conventional sheet aligner (such as shown in U.S. Pat. No. 5,267,731, the disclosure of which is incorporated by reference herein) for aligning the edges of sheets just prior to engagement with the top conveyor. Just before the edge aligner may also be provided an infeed conveyor which accommodates bar code scanning or other types of scanning, or a fixed counter, which allows proper grouping of the stack. That is, the number of forms or other sheets that are desired to be placed into a stack may be counted at the infeed conveyor, or the last form in a stack having a bar code or other sense mark thereon scanned, which then—after a short time delay—signals the equipment feeding the stacker infeed conveyor to stop feeding forms (or temporarily arrests an infeed conveyor), moves the bottom support into proper position for ejecting the forms from the interior volume, actuates the paddles to eject the forms, and then moves the bottom support to its initial position. Means are provided (such as guide rods) for mounting the stacker for horizontal adjustment with respect to the aligner in a direction substantially transverse to the first direction to allow left edge, right edge, or center alignment.

According to another aspect of the present invention, a variable sheet stacker is provided comprising the following components: First and second side members which extend substantially vertically and are spaced from each other substantially horizontally. An inlet end support at an inlet for the stacker. An outlet end guide disposed opposite the inlet support horizontally spaced therefrom at an outlet for the stacker. A top conveyor for conveying cut sheets past the inlet support toward the outlet end guide, in a first direction. A bottom support vertically spaced from the top conveyor for supporting cut sheets. The inlet end support and outlet end guide, top conveyor, side members, and bottom support defining an open interior volume having substantially a rectangular prism configuration. And, wherein the top conveyor comprises a frame that is pivotal about a horizontal axis substantially perpendicular to the first direction and adjacent the outlet to move between a conveyance position and an inoperative position. The details of all of the components may be as set forth above.

According to yet another aspect of the present invention, a variable cut sheet stacker is provided comprising the following components: First and second side members which extend substantially vertically and are spaced from each other substantially horizontally. An inlet end support at an inlet for the stacker. An outlet end guide disposed opposite the inlet support horizontally spaced therefrom at an outlet for the stacker. A top conveyor for conveying cut sheets past the inlet support toward the outlet end guide, in a first direction. A bottom support vertically spaced from the top conveyor for supporting cut sheets. The inlet end support and outlet end guide, top conveyor, side members, and bottom support defining an open interior volume having substantially a rectangular prism configuration. And, eject means associated with the side members for, upon activation, moving sheets stacked in the interior volume out the outlet end. The details of all of the components may be as described above.

It is the primary object of the present invention to provide a simple, effective, yet readily-adjustable cut sheet stacker for use with a wide variety of sheets, particularly business forms. This and other objects of the invention will become clear from an inspection of the detailed description of the invention, and from the appended claims.

DETAILED DESCRIPTION OF THE DRAWINGS

Figure 1:
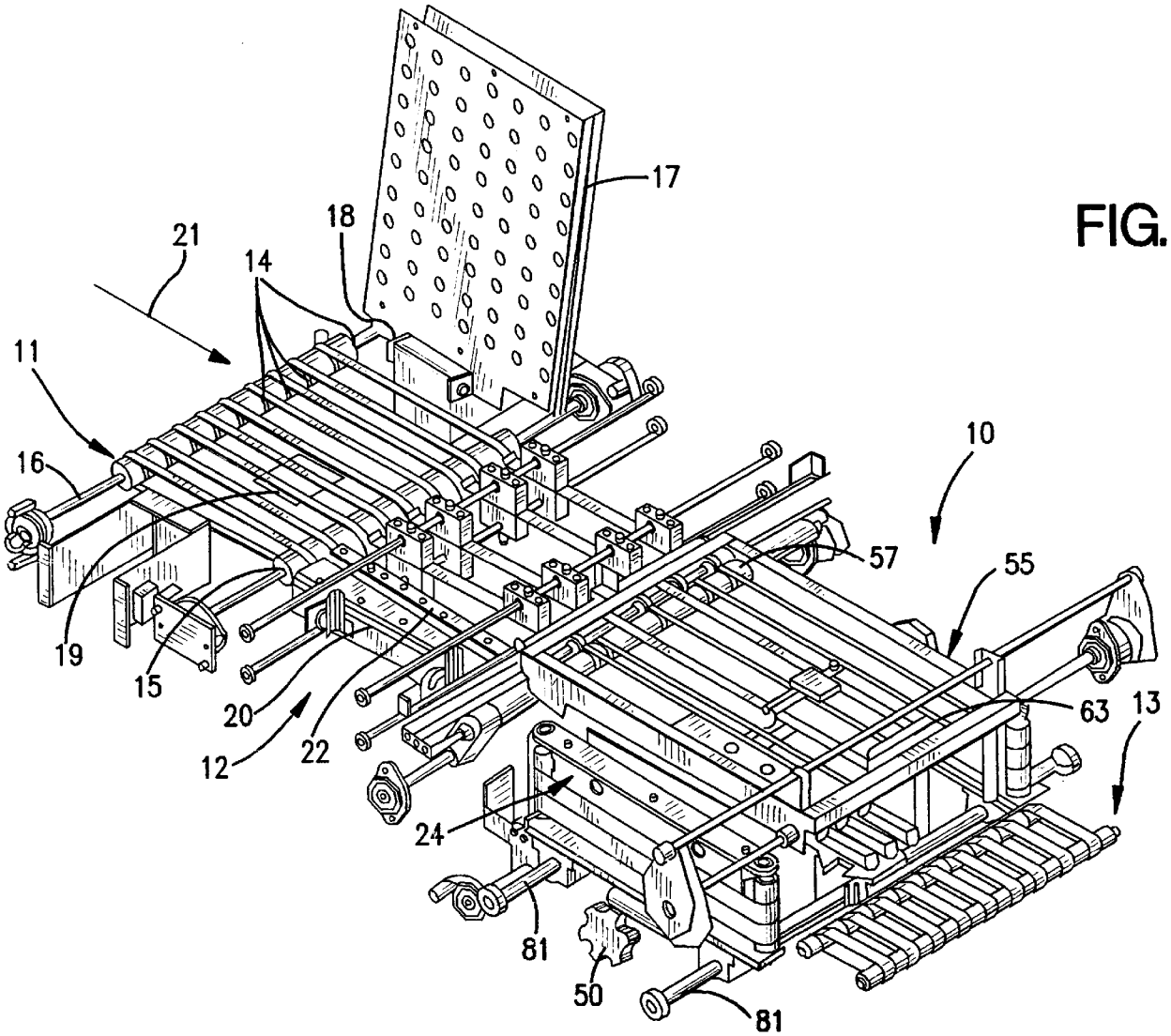
FIG. 1 is a top perspective view of an exemplary cut sheet stacker according to the invention, shown in combination with an inlet end feed conveyor, edge aligner, and an outfeed conveyor.

An exemplary, variable cut sheet stacker according to the present invention is shown generally by reference numeral 10 in FIGS. 1 through 5. As seen in FIG. 1, the stacker 10 preferably is associated with an infeed conveyor, shown generally by reference numeral 11, and edge aligner, shown generally by reference numeral 12, and an outfeed conveyor, shown generally by reference numeral 13. The infeed conveyor 11 is of conventional construction, such as comprising conveyor tapes connected between rotatable rollers 15, 16, and a top guide and support element 17 may be pivotally mounted to a frame 18 for pivotal movement to overlie the conveyor belts or tapes 14. Some sort of sensing mechanism is preferably mounted under the infeed conveyor 11 (or associated with the overlying structure 17), such as a bar code scanner or other sense mark scanning device, or a mechanical, electrical or electromechanical counter, to determine the number of forms that are being fed to the cut sheet stacker 10 for stacking. Once the desired number of sheets, such as business forms, have been sensed or counted by the scanners or counters or the like—shown schematically at 19 in FIG. 1—through conventional controls a machine feeding conveyor 11, and/or the equipment 10 through 13, is controlled to arrest the feed of sheets to the stacker 10, eject the final stack from the stacker 10 using the outfeed conveyor 13, and be ready to start the formation of the next stack.

Preferably bar code reading and sensor/counter devices are provided as the structure 19, and structure 19 is located under the belt portion of the infeed conveyor 11. By doing so, the bar code is expected to be read up between the ¼ inch wide belts 14 as the forms pass by and at the same time be allowed to be adjusted horizontally substantially perpendicular to the paper direction so that no matter where the bar code is on the form the bar code scanner can be adjusted to read it. There is another sensor mounted on the same bracket that moves along with the bar code reader. That sensor counts forms entering the machine 10.

The edge aligner 12 may comprise any conventional edge aligner for aligning sheets. It is preferred, however, that the edge aligner 12 be such as described in U.S. Pat. No. 5,265,731 (the disclosure of which is hereby incorporated by reference herein) which includes a side edge bar 20 that extends essentially parallel to the generally-horizontal direction of conveyance of sheets—as illustrated schematically by arrow 21 in FIG. 1—with a conventional strip having ball bearings mounted therein as seen schematically at 22 in FIG. 1. The conventional edge aligner 12 can provide center alignment, left edge alignment, or right edge alignment depending upon its particular construction, and delivers the sheets directly to the vertical stacker 10 for stacking.

The invention may be practiced with almost any type of relatively-thin sheet. However, the invention is particularly suited for use with business forms as the sheets. The business forms may comprise an individual paper sheet (i.e., have a single ply), or be multi-ply.

The outfeed conveyor 13 utilized with the sheet stacker 10 may be of any conventional construction, being only illustrated schematically in FIG. 1. According to the preferred embodiment of the invention, however, it need not be vertically adjustable because the stack will always be ejected from the stacker 10 at the same bottom height. This simplifies the construction of the outfeed conveyor 13.

The vertical stacker 10 according to the present invention has a number of unique characteristics. It is primarily designed to allow easy adjustment of the height, width and length dimensions of a substantially rectangular prism interior volume in which the sheets are stacked. This is accomplished by allowing adjustability of all of the major components defining the six sides of such a prism, and providing a particularly suitable top conveyor for properly conveying the forms or other sheets, yet allowing ready adjustment, and a suitable simple eject mechanism for effectively ejecting the sheets in a stack with minimum time delay.

The vertical cut sheet stacker 10 includes first and second side members 24, 25. The side members may comprise fences 26, 27 which face each other and extend substantially vertically and are spaced from each other substantially horizontally (substantially transverse to the first direction 21). The fences 26, 27 are mounted to interior support towers 28, 29 which each have rollers 30, 31 at the front and rear ends thereof, which are mounted for rotational movement, such as in a stationary support 32. Moving on the outside of the rollers 30, 31 is an endless band, belt or chain 33, and which has one, or a pair, of substantially-vertical paddles 34 (best seen in FIGS. 3 and 2) mounted thereto and extending horizontally outwardly therefrom. The paddles 34 are designed and positioned—as illustrated in FIG. 3—so that they move interiorly of the fences 26, 27 but do not interfere with the fences 26, 27 as they move in the direction of arrow 21 with respect to the fences 26, 27. While two paddles 34 are illustrated per element, preferably only one is provided.

The paddles 34, bands, etc., 33, and rollers 30, 31 comprise part of the eject means for ejecting forms other stacked sheets from the interior volume of the stacker 10, as will be hereinafter described. While this paddle arrangement is preferred, if desired other types of eject means, such as conventional pushers or accessory conveyor belts or systems, may be provided.

The rollers 31 preferably are driven—on demand—to move the paddles 34. Any suitable conventional means may be provided for performing that function. In the embodiment illustrated in the drawings, such means take the form of a drive shaft 36 driven by an electrical motor 37 or the like, such as a stepper motor, and connected via gears 38 and gear boxes 39 to the central shafts of the rollers 31 to effect rotation thereof. Any other suitable structure, such as pulleys, sprockets or the like may be provided if desired, for the paddle moving means.

The means for moving the paddles 34 preferably automatically move the paddles 34 the length of the side members 24, 25 in the first direction 11, and then automatically stop. This is typically provided by using the end of cycle switch 41 (see FIG. 2) and end-of-travel tab 42. This switch 41, when engaged by a paddle 34 after it (or its associated paddle of a pair) has traversed its path (or the length of the side member 24, 25) to eject a stack from the stacker 10, deactivates a conventional clutch or drive train (not shown) for the motor 37. The motor 37 typically runs continuously. The tab 42 positively stops the movement of the paddle 34 at the position where it engages the end-of-cycle switch 41. The tab 42 may be moved out of the way when the next operation of the paddles 34 starts by any suitable conventional mechanism, such as a momentarily operated solenoid which pivots or otherwise moves tab 42 out of the path of travel of the paddle 34 until the paddle 34 clears it, then moving back to a blocking position.

The side members 24, 25 are mounted so that the relative positions thereof with respect to each other may be adjusted. The means for adjusting the relative horizontal position between them, in a direction perpendicular to the first direction 21, may comprise a wide variety of conventional structures such as ganged or geared-together elements, pneumatic cylinders, etc. While a wide variety of conventional structures may be utilized to effect adjustment of the positions in the side members 24, 25 (and the fences 26, 27 associated therewith); in the preferred embodiment illustrated in the drawings, the adjustment mechanism comprises a threaded screw, shown generally by reference numeral 44 in FIG. 3, which may be mounted at a central portion thereof to a central support 45, with traveling nut portion 46, 47 at opposite ends thereof. One section of the shaft 44 is left-hand threaded, while the other section is right-hand threaded; for example, the section 48 in FIG. 3 is left-hand threaded and the section 49 is right-hand threaded—so that when the shaft 44 is rotated, the traveling nuts 46 move in unison either toward or away from each other depending upon the direction of rotation of the shaft 44. While the shaft 44 may be rotated by any conventional mechanism, powered or manual, preferably it is rotated by turning a simple hand wheel 50 which is fixed to one end thereof.

Figure 2:
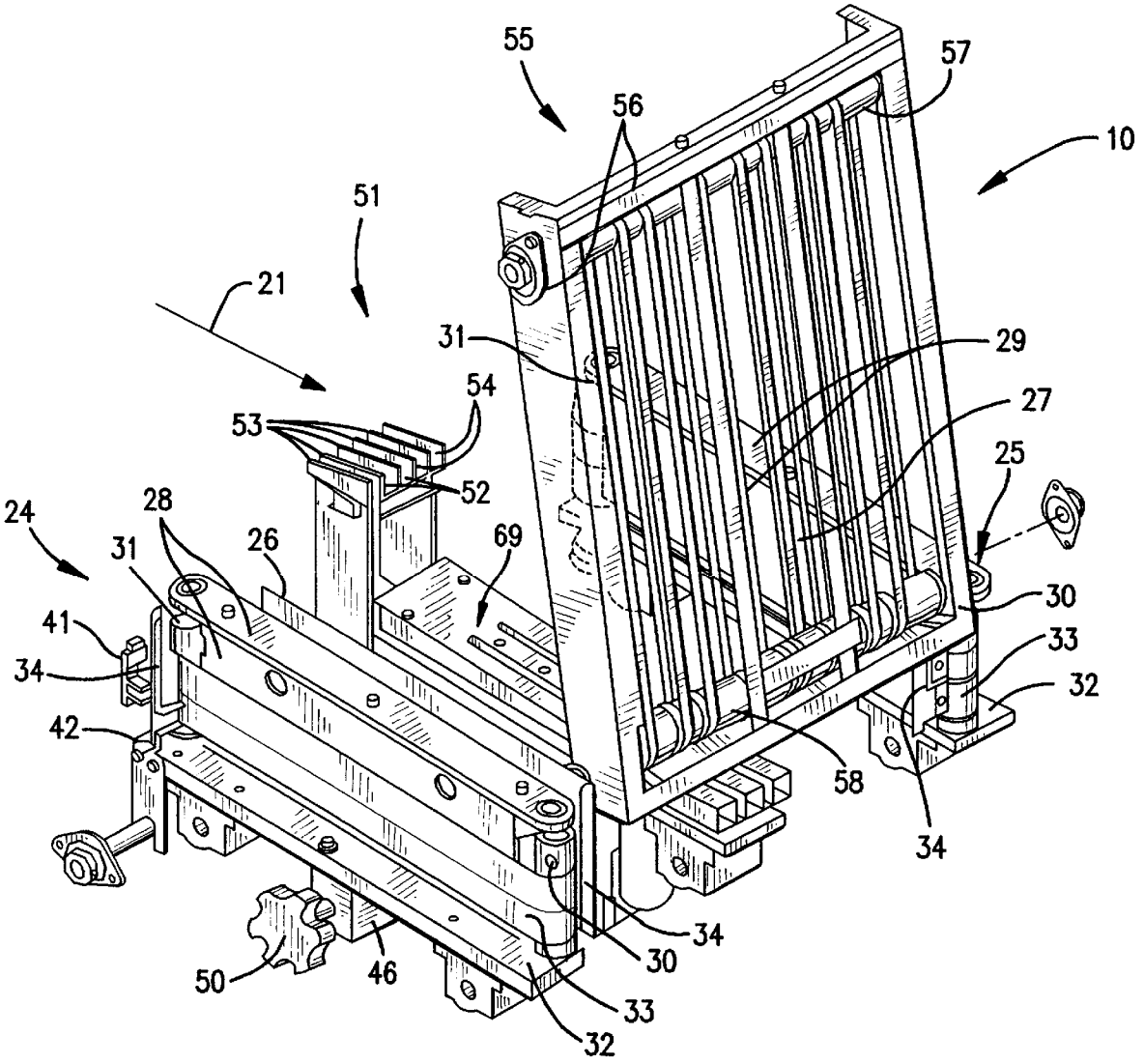
FIG. 2 is a view like that of FIG. 1 for the vertical stacker per se, and shown with the top conveyor pivoted upwardly to an inoperative, adjustment-facilitating, position.
Figure 3:
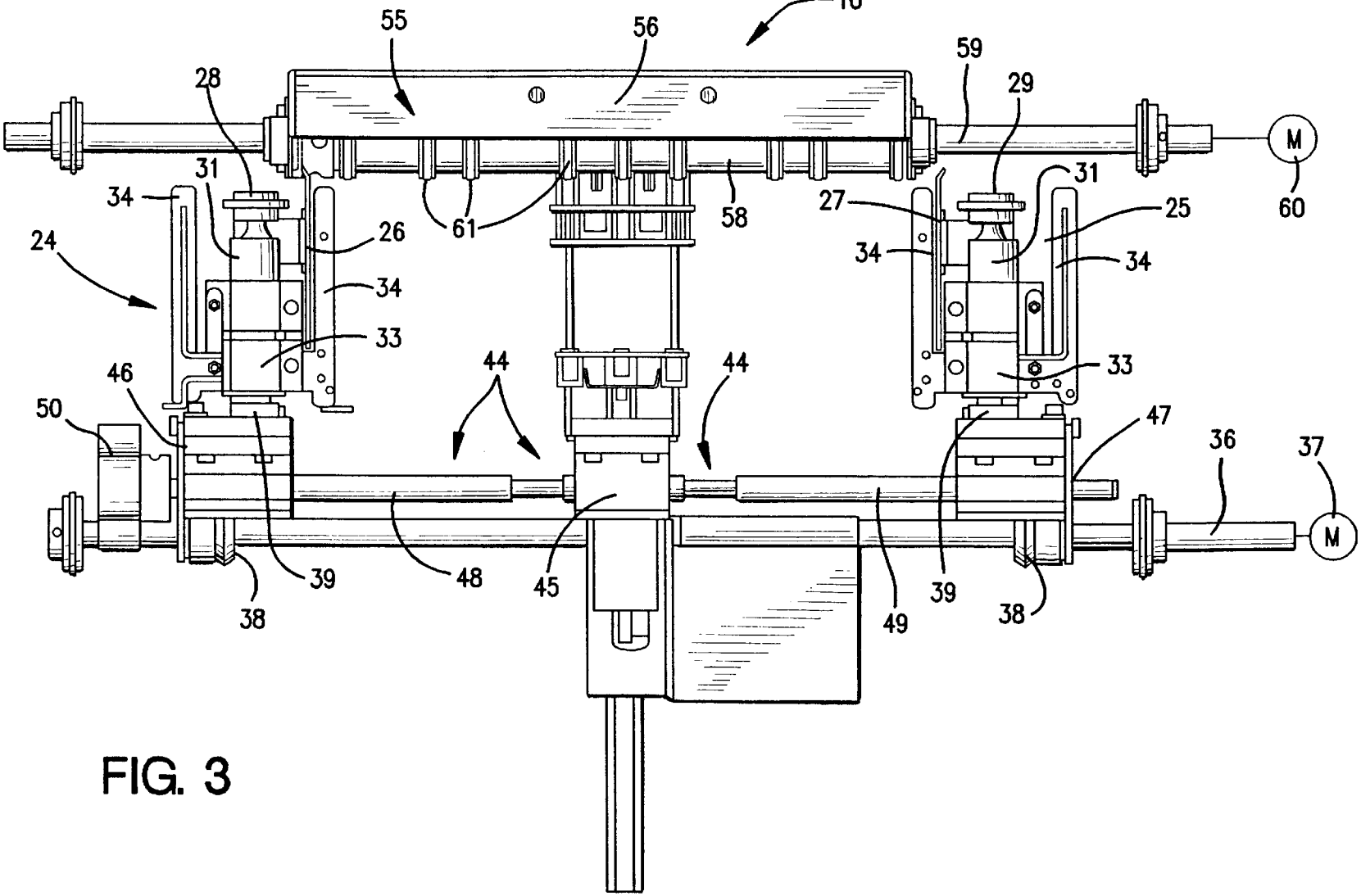
FIG. 3 is a front end view (looking in at the outfeed end) of the stacker of FIGS. 1 and 2.
Figure 4:
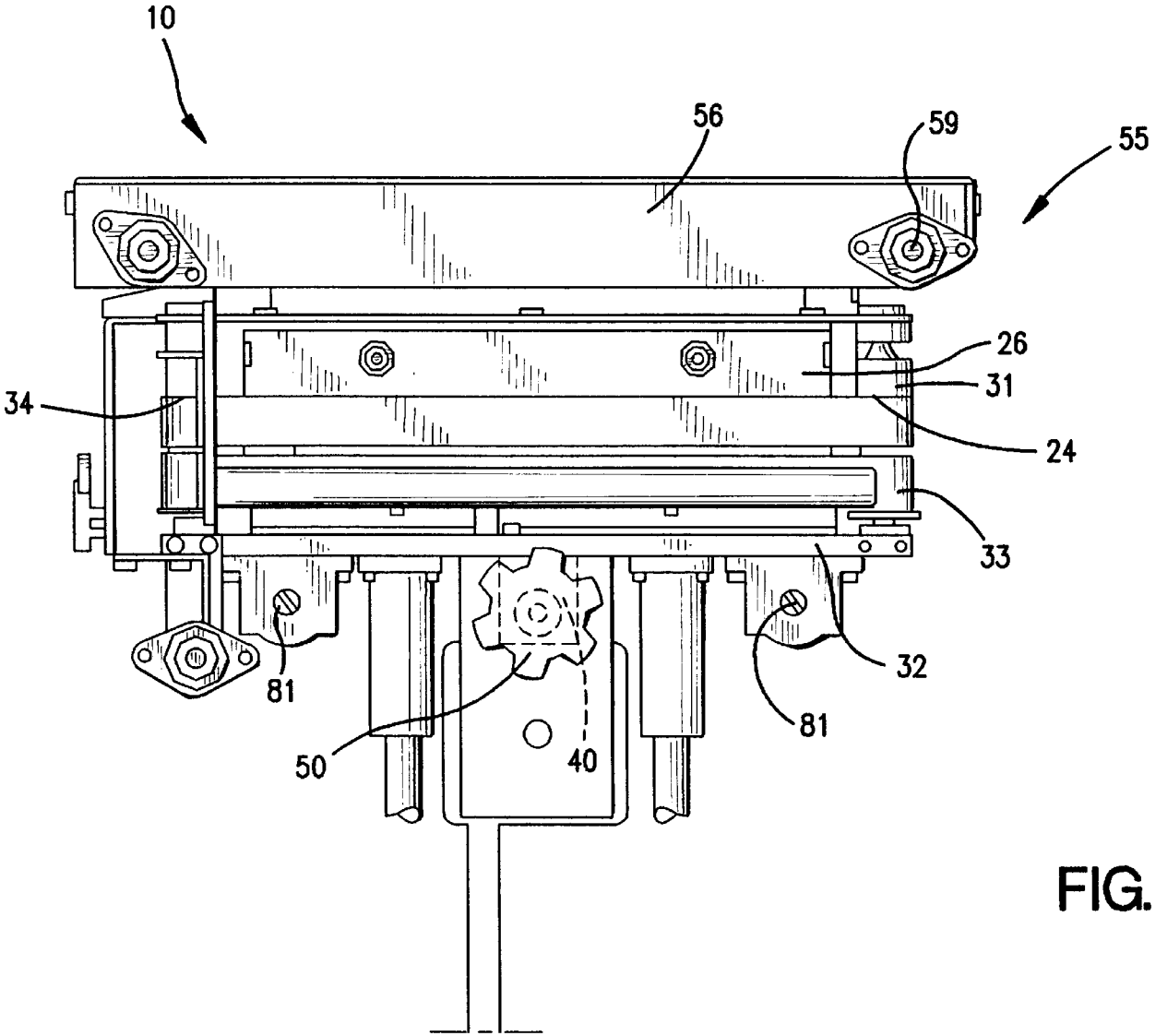
FIG. 4 is a side view (looking in at the left side of FIG. 3) of the vertical stacker of FIGS. 1 through 3.
Figure 5:
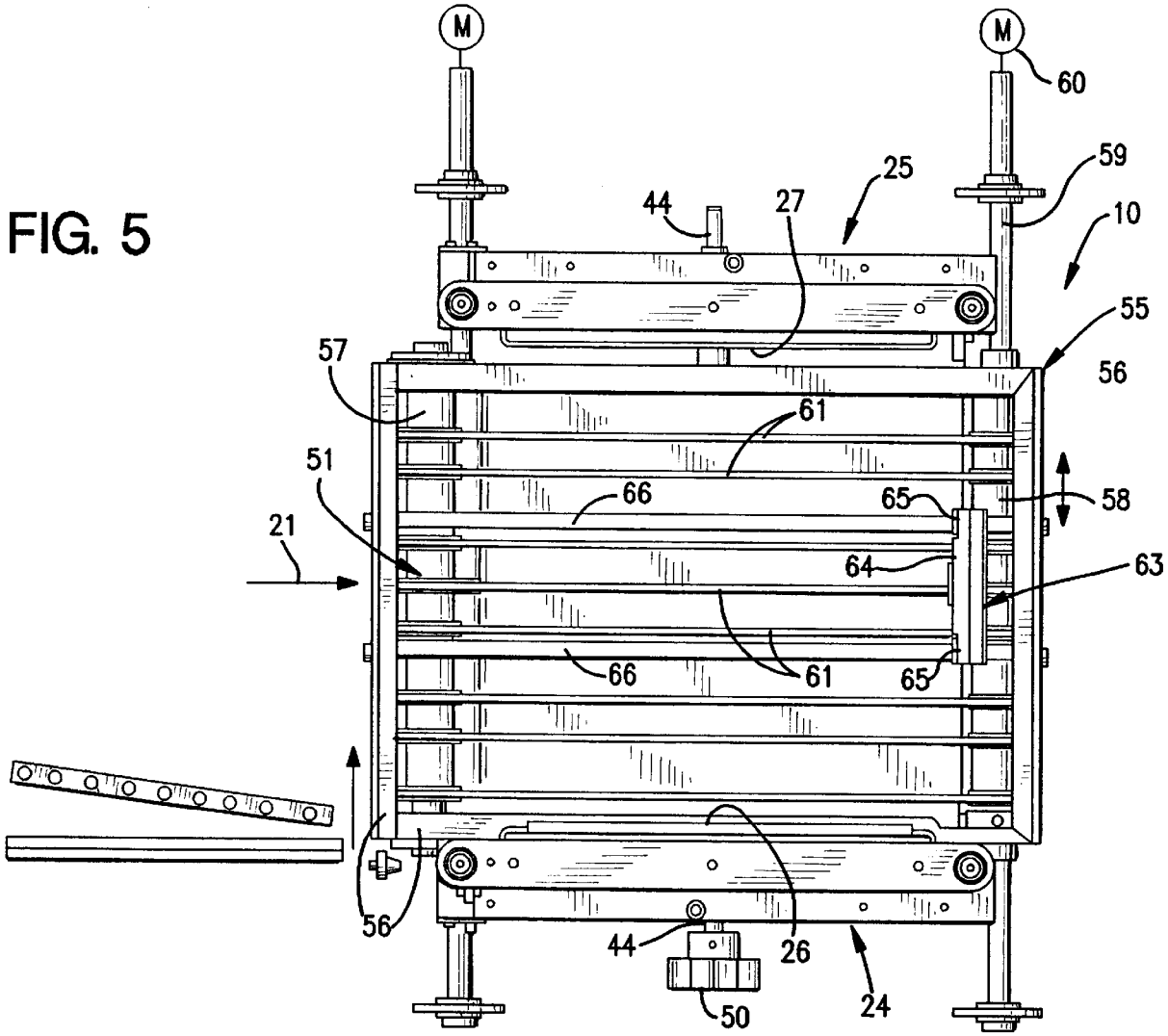
FIG. 5 is a top plan view of the vertical stacker of FIGS. 1 through 4.

The vertical stacker 10 also includes an inlet end support, shown generally by reference numeral 51, and best seen in FIGS. 2 and 3, adjacent the edge aligner 12. The inlet end support 51 is preferably mounted to the center support 45, extending upwardly therefrom. At the top of the end support 51 are a plurality of ramps 53 which slope upwardly from the edge aligner 12, having an inner edge or face 52 (see FIG. 2) that provides a fence for the trailing edge of the sheet when it enters the stacker 10. Channels 54 defined by ramps 53 cooperate with the conveyor associated with the vertical stacker 10, as will be hereinafter described. The inlet structure 51 is stationary with respect to the side members 24, 25.

The stacker 10 also comprises a top conveyor, 55. The top conveyor 55 includes a substantially-rectangular exterior frame 56 that mounts first and second rollers 57, 58 for rotation about parallel horizontal axes substantially perpendicular to the first direction 21, at least one of the rollers 57, 58 being driven. Preferably the roller 58, which is on the outlet side of the stacker 10, is driven, as by rotation of the shaft 59 (see FIGS. 3 and 5) by a conventional electric motor 60. Extending between the rollers 57, 58 are conveying elements, such as conventional conveyor belts or tapes. Preferably a plurality of conveyor tapes 61 are provided, such as nine different conveyor tapes or belts 61 as seen most clearly in FIGS. 3 and 5. Preferably, the tapes or belts 61 have substantially circular cross sections and are of elastic material.

FIG. 3 illustrates the normal operating position of the top conveyor 55. As seen in both FIGS. 3 and 5, the three interior belts 61 preferably are guided by the channels 54 of the ramps 53. In operation of the top conveyor 55, each individual business form being fed to the stack 10 is dragged up the ramps 53 and the lead edge of the form falls down to meet the form before it in the stack. The O-ring configuration belts 61 drag the form along the form below it and up against the outlet end guide 63. The outlet end guide 63 is preferably mounted on the top conveyor 55 but its position is adjustable with respect to the inlet end support 51. This adjustment may be effected in any suitable conventional manner. In the embodiment illustrated in the drawings (with particular reference to FIG. 5), the outlet end guide 63 includes the vertical plate 64 which has bushings 65 in openings therein which receive rods 66 which are stationarily mounted to the front and rear portions of the frame 56, the rods 66 extending substantially parallel to the first direction 21. The conventional bushings 65 are designed so that when the guide 63 is moved to a particular position along the rods 66 it will remain in place until again manually moved, even though forms will be substantially continuously conveyed into contact therewith.

Preferably, the entire top conveyor 55 is mounted so that it can be pivoted with respect to the inlet structure 51. This is highly desirable in order to allow effective adjustment of the various components, especially adjustment of the side members 24, 25 with respect to each other. If pivotal action were not provided, then the side members 24, 25, and associated fences 26, 27 would have a less-desirable design and would not maintain a positive internal volume, i.e., one which properly maintains the forms in the stack in as desirable a manner. Preferably, the top conveyor 55 is pivoted adjacent the outlet end thereof (that is, closest to the outlet conveyor 13), the frame 56 being pivotally mounted thereat. While a number of conventional mechanisms may be utilized for allowing this pivotal movement, in the embodiment illustrated in the drawings this is accomplished by shaft 59. Merely by grabbing the end of the frame 56 overlying the inlet structure 51 the outlet end is pivoted about the—at that time, motionless—shaft 59. This pivoting action also allows access to the interior volume of the stacker 10 for clearing of jams, removal of foreign material or the like.

Figure 6:
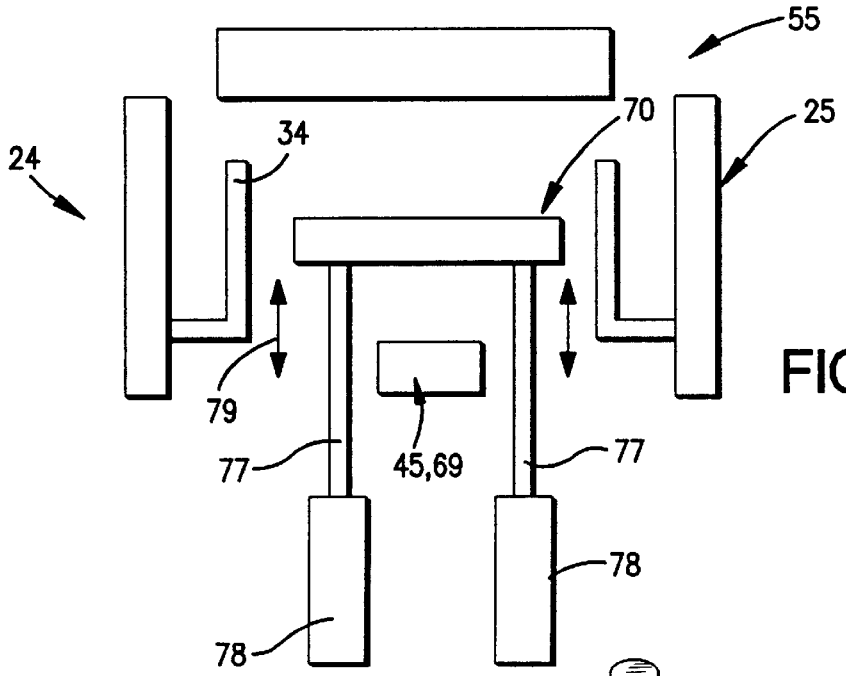
FIG. 6 is an end schematic view showing one form of an exemplary bottom support, with adjustment mechanism, according to the invention.
Figure 7:
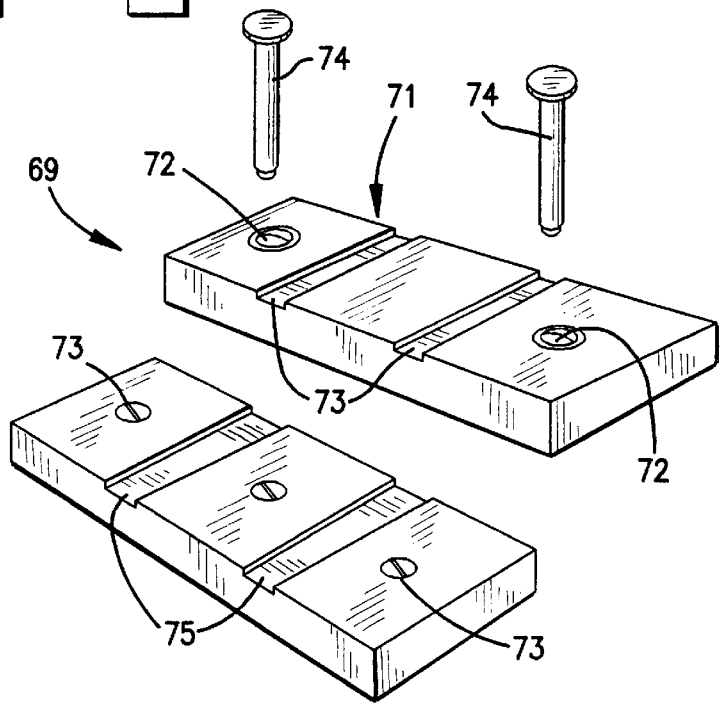
FIG. 7 is a top perspective view of a second form of bottom support adjustment mechanism that may be provided according to the present invention.

The stacker 10 still further comprises a bottom support, shown by reference numeral 69 in FIGS. 2 and 7, and by reference numeral 70 in FIG. 6. The bottom support 69, 70 is vertically spaced from the top conveyor 55 and is for supporting cut sheets thereon. Adjustment of the vertical spacing between the elements 69, 70 and the top conveyor 55 may be accomplished in any number of conventional suitable manners. For example, as illustrated in FIG. 7, various blocks or trays 71 may be provided which may be stacked on the support 69 to effectively raise the top surface thereof. For example, as illustrated in FIG. 7, the block 71 has openings 72 therein which are aligned with similar openings 73 in the support 69 with guide pins 74 passing through the openings 72, 73. The openings 72 may have a recessed portion at the top thereof, as seen in FIG. 7, for receipt of the heads of the guide pins 74 so that the guide pin heads are flush with the top of the block 71. Magnets 75 may also be provided for holding the block 71 to the support 69, and/or for holding other blocks on top of block 71. Any number of blocks or trays 71 may be placed one on top of the other so that the bottom of the interior stacking volume is adjustable with respect to the top conveyor 55.

While a wide variety of different adjustment structures for the bottom support may be provided, in order that adjustment of the height of the outlet conveyor 13 need not be provided preferably a structure like the structure 70 in FIG. 6 is provided. Structure 70 comprises a horizontal plate or tray which is connected to piston rods 77 of two or more pneumatic or hydraulic cylinders 78 which adjust the position of the plate 70 vertically as indicated by the arrow 79 in FIG. 6. [Alternatively, there may be provided three parallel circular cross-section shafts of which the center one is actually the rack of a rack and pinion gear set. The pinion of the rack and pinion is attached directly to a stepper motor so that extremely precise positioning of the stacker tray can be realized.] In operation the plate 70 is moved to the vertical position which defines the height of the stack desired, and then after the stack has been formed, passage or feed of sheets to the stacker 10 is arrested, and the cylinders 78 (or stepper motor) are operated to move the plate 70 down to the position where it is vertically aligned with the outfeed conveyor 13 so that when the paddles 34 are operated they push the stack of forms right onto the conveyor 13 without requiring any adjustment of the height thereof.

The elements 24, 25, 52, 61, 64 and 70 define an interior volume of the stacker 10 having a substantially rectangular prism configuration (a cube being a special case of a rectangular prism), and as seen in the description above, all of the components may be readily adjusted with respect to each other so as to define a variable volume. These structures collectively provide for adjustment of the internal volume from between approximately 3.5"×3.5" by 1 sheet thickness in height in the minimum configuration, to about 12"×12" by 3" height in the maximum configuration. All dimensions in between also may be provided. This allows the stacker 10 to be readily used with a wide variety of conventional business forms or other sheets, such as booklets, mailers, pressure seal components, or the like, the mailers being accommodated either before or after folding.

Another desirable feature according to the present invention is that the entire stacker 10 may be adjusted depending upon the forms being acted upon so as to accommodate adjustment in the aligner 12 or other feed equipment. This is accomplished, for example, by mounting the entire structure 32, 45, etc. on a pair of stationary guide rods 81 (see FIGS. 1 and 4 in particular) so that the entire stacker 10 may be shifted in the horizontal dimension perpendicular to the first direction 21. The conveyor 55 is also adjustable in that dimension along the drive shaft 59 (the shaft 59 and the roller 58 may be connected by a suitable spline or key arrangement) such as by loosening an eccentric drive nut, moving the frame 56 to the desired position, and retightening.

Figure 8:
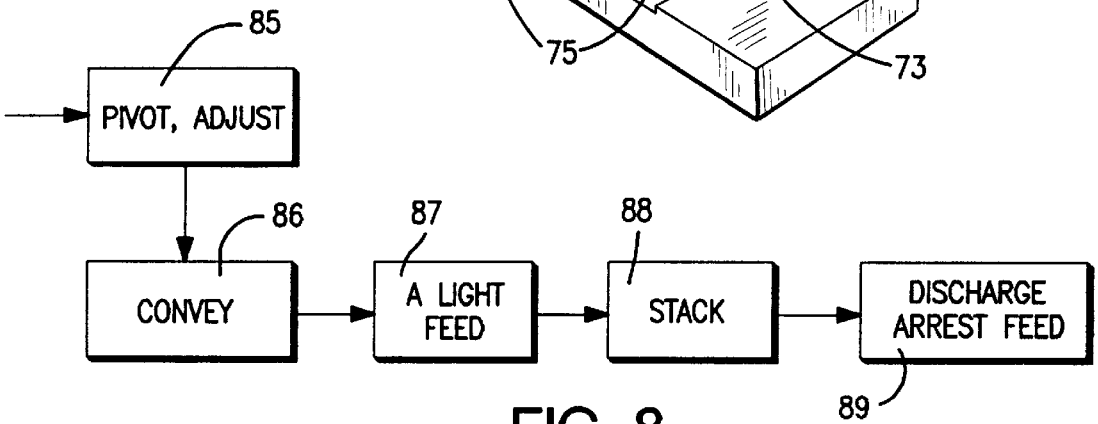
FIG. 8 is a schematic box diagram indicating the sequence of operation of the equipment elements according to the present invention in the preferred manner of utilization thereof.

FIG. 8 schematically illustrates exemplary operation of the equipment illustrated in FIG. 1 according to the present invention. First, the top conveyor 55 is pivoted about the shaft 59—as seen in FIG. 2—and the various components that need adjustment are adjusted. For example, the knob 50 is turned to move the side elements 24, 25 toward or away from each other, and suitable blocks 71 are put in place or the platform 70 adjusted, and the position of the outlet end guide 63 is adjusted along the rods 66. This pivot and adjustment action is illustrated schematically at 85 in FIG. 8. Then the equipment is operated so that the conveyor 11 conveys the forms in the direction 21 as illustrated at 86, and the forms are edge aligned and fed to the stacker 10 as illustrated at 87 in FIG. 8, using the aligner 12. Vertical stacking takes places in the stacker 10 as indicated schematically at 88 in FIG. 8, and once a stack of desired height has been formed it is discharged. Formation of the stack of desired height may be determined in a number of different manners, such as by utilizing the counter or scanner 19, or by sensing within the interior volume of the stacker 10 itself. When the stack is discharged and the feed arrested as indicated at 89 in FIG. 8, the conveyor 11 stops conveying forms to the edge aligner 12. The feeding machinery (and/or conveyor 55) may be arrested, the platform 70 is moved by the cylinders 78 (or stepper motor) down to the level of the outfeed conveyor 13, and the paddles 34 are operated to push the stack onto the conveyor 13. When the paddles 34 reach their end of travel, platform 70 is moved back to its desired position adjacent the conveyor 55 (typically only about two seconds), and the conveyor 11 is restarted.

It will thus be seen that according to the present invention, a very effective variable cut sheet stacker has been provided. While the invention has been herein shown and described in what is presently conceived to be the most practical and preferred embodiments thereof, it is to be apparent to those of ordinary skill in the art that many modifications may be made thereof within the scope of the invention, which scope is to be accorded the broadest interpretation of the appended claims so as to encompass all equivalent structures and devices.

What is claimed is:

1. A variable cut sheet stacker, comprising:

first and second side members which extend substantially vertically and are spaced from each other substantially horizontally;

an inlet end support at an inlet for said stacker;

an outlet end guide disposed opposite said inlet support horizontally spaced therefrom at an outlet for said stacker;

a top conveyor for conveying cut sheets past said inlet support toward said outlet end guide, in a first direction;

a bottom support vertically spaced from said top conveyor for supporting cut sheets;

said inlet end support and outlet end guide, top conveyor, side members, and bottom support defining an open interior volume having substantially a rectangular prism configuration;

means for adjusting the relative positions of said side members with respect to each other;

means for adjusting the horizontal spacing of said inlet end support and said outlet end guide in said first direction; and means for adjusting the vertical spacing of said top conveyor and bottom support.

2. A variable cut sheet stacker as recited in claim 1 wherein said top conveyor comprises a frame that is pivotal about a horizontal axis substantially perpendicular to said first direction to move between a conveyance position and an adjustment-facilitating position, and wherein said outlet end guide is mounted to said top conveyor for pivotal movement therewith.

3. A variable cut sheet stacker as recited in claim 2 wherein said inlet end support is fixed and includes an upper ramp which cooperates with said conveyor, and wherein said means for adjusting the horizontal spacing of said inlet end support and said outlet end guide comprises means for mounting said outlet end guide to said conveyor so that said outlet end guide is movable with respect to said inlet end support to adjust the position therebetween.

4. A variable cut sheet stacker as recited in claim 3 wherein said means for adjusting the horizontal spacing of said inlet end support and said outlet end guide comprises a pair of guide rods mounted to said conveyor supporting frame, said rods elongated in said first direction, and said outlet end guide comprising a vertical plate having openings for receiving said rods, with bushings in said openings.

5. A variable cut sheet stacker as recited in claim 1 in combination with a sheet aligner for aligning the edges of sheets just prior to engagement with said top conveyor.

6. A variable cut sheet stacker as recited in claim 4 further comprising means for mounting said stacker for horizontal adjustment with respect to said aligner in a direction substantially transverse to said first direction.

7. A variable cut sheet stacker as recited in claim 1 further comprising eject means associated and adjustable with said side members for, upon activation, moving sheets stacked in said interior volume out said outlet end.

8. A variable cut sheet stacker as recited in claim 7 wherein said eject means comprises a vertical paddle mounted with each side member for movement with respect to each of said side members in said first direction, and means for moving said paddles in said first direction.

9. A variable cut sheet stacker as recited in claim 8 wherein said means for moving said paddles comprises means for automatically moving said paddles at least the length of said side members in said first direction and then automatically stopping.

10. A variable cut sheet stacker as recited in claim 1 wherein said inlet end support comprises a central support substantially evenly spaced between said side members, and wherein said means for adjusting the positions of said side members with respect to each other move said side members uniformly toward and away from said central support.

11. A variable cut sheet stacker as recited in claim 10 wherein said means for adjusting the positions of said side members comprising a screw threaded shaft extending between said side member substantially perpendicular to said first direction, and a traveling nut portion of each of said side members for engaging said screw threaded shaft and linearly moving toward and away from said central support in response to rotation of said screw threaded shaft.

12. A variable cut sheet stacker as recited in claim 1 wherein said top conveyor comprises: an exterior frame; first and second rollers rotatably mounted to said frame and extending substantially perpendicular to said first direction, at least one of said rollers driven; and a plurality of conveyor tapes extending between said rollers.

13. A variable cut sheet stacker as recited in claim 12 wherein said inlet end support comprises a guide cooperating with a plurality of said conveyor tapes for positively guiding said conveyor tapes when moving in said first direction.

14. A variable cut sheet stacker as recited in claim 1 wherein said means for adjusting the relative positions of said side members with respect to each other, said means for adjusting the horizontal spacing of said inlet end support and said outlet end guide in said first direction, and said means for adjusting the vertical spacing of said top conveyor and bottom support, collectively provide for adjustment of said internal volume from between approximately 3.5 inches by 3.5 inches by 1 sheet thickness in height, and approximately 12 inches by 12 inches by 3 inches in height.

15. A variable cut sheet stacker, comprising:

first and second side members which extend substantially vertically and are spaced from each other substantially horizontally;

an inlet end support at an inlet for said stacker;

an outlet end guide disposed opposite said inlet support horizontally spaced therefrom at an outlet for said stacker;

a top conveyor for conveying cut sheets past said inlet support toward said outlet end guide, in a first direction;

a bottom support vertically spaced from said top conveyor for supporting cut sheets;

said inlet end support and outlet end guide, top conveyor, side members, and bottom support defining an open interior volume having substantially a rectangular prism configuration; and wherein said top conveyor comprises a frame that is pivotal about a horizontal axis substantially perpendicular to said first direction and adjacent said outlet to move between a conveyance position and an inoperative position.

16. A variable cut sheet stacker as recited in claim 15 wherein said outlet end guide is mounted to said top conveyor for pivotal movement therewith.

17. A variable cut sheet stacker as recited in claim 16 wherein said top conveyor comprises: first and second rollers rotatably mounted to said frame and extending substantially perpendicular to said first direction, at least one of said rollers driven; and a plurality of conveyor tapes extending between said rollers; and wherein said inlet end support comprises a guide cooperating with a plurality of said conveyor tapes for positively guiding said conveyor tapes when moving in said first direction.

18. A variable cut sheet stacker, comprising:

first and second side members which extend substantially vertically and are spaced from each other substantially horizontally;

an inlet end support at an inlet for said stacker;

an outlet end guide disposed opposite said inlet support horizontally spaced therefrom at an outlet for said stacker;

a top conveyor for conveying cut sheets past said inlet support toward said outlet end guide, in a first direction;

a bottom support vertically spaced from said top conveyor for supporting cut sheets;

said inlet end support and outlet end guide, top conveyor, side members, and bottom support defining an open interior volume having substantially a rectangular prism configuration; and eject means associated with said side members for, upon activation, moving sheets stacked in said interior volume out said outlet end.

19. A variable cut sheet stacker as recited in claim 18 wherein said eject means comprise a vertical paddle mounted with each side member for movement with respect to each of said side members in said first direction, and means for moving said paddles in said first direction.

20. A variable cut sheet stacker as recited in claim 19 wherein said paddle moving means comprises means for automatically moving said paddles at least the length of a said side member in said first direction and then automatically stopping.

* * * * *